US011313182B2

(12) United States Patent
Harrigan et al.

(10) Patent No.: US 11,313,182 B2
(45) Date of Patent: Apr. 26, 2022

(54) SYSTEM AND METHOD FOR CENTRALIZING A TOOL IN A WELLBORE

(71) Applicant: Halliburton Energy Services, Inc., Houston, TX (US)

(72) Inventors: Edward Harrigan, Richmond, TX (US); Adan Hernandez Herrera, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 269 days.

(21) Appl. No.: 16/686,271

(22) PCT Filed: Dec. 20, 2018

(86) PCT No.: PCT/US2018/066927
§ 371 (c)(1),
(2) Date: Nov. 18, 2019

(87) PCT Pub. No.: WO2020/131084
PCT Pub. Date: Jun. 25, 2020

(65) Prior Publication Data

US 2021/0277724 A1 Sep. 9, 2021

(51) Int. Cl.
*E21B 17/10* (2006.01)
*E21B 43/1185* (2006.01)
*E21B 43/119* (2006.01)

(52) U.S. Cl.
CPC ..... *E21B 17/10* (2013.01); *E21B 43/119* (2013.01); *E21B 43/1185* (2013.01)

(58) Field of Classification Search
CPC .... E21B 17/10; E21B 43/1185; E21B 43/119; E21B 43/117
See application file for complete search history.

(56) References Cited

U.S. PATENT DOCUMENTS 2,640,547 A * 6/1953 Baker ..... E21B 23/065 166/63
2,807,325 A * 9/1957 Webb ..... E21B 23/065 166/63
2,978,028 A * 4/1961 Webb ..... E21B 23/065 166/63
3,104,709 A 9/1963 Kenneday et al.
(Continued)

FOREIGN PATENT DOCUMENTS

WO 03098639 A1 11/2003

OTHER PUBLICATIONS

International Search Report and Written Opinion dated Aug. 29, 2019 for PCT Application No. PCT/US2018/066927 filed Dec. 20, 2018, 14 pgs.

*Primary Examiner* — Daniel P Stephenson
(74) *Attorney, Agent, or Firm* — Chamberlain Hrdlicka

(57) ABSTRACT

A centralizing perforating gun for perforating a tubular in a wellbore include a gun housing, perforating charges positioned within the gun housing and detonatable to perforate the tubular, and a centralizing system. The centralizing system includes an extendable member configured to move between a retracted position and an extended position. The extendable member is configured to engage a surface of the tubular in the extended position, thereby biasing the centralizing perforating gun away from the surface of the tubular.

17 Claims, 9 Drawing Sheets

(56) References Cited

U.S. PATENT DOCUMENTS 3,385,364 A * 5/1968 Whitten ..... E21B 49/10 166/100
3,468,386 A * 9/1969 Johnson ..... E21B 43/11 175/4.6
4,306,628 A * 12/1981 Adams, Jr ..... F42D 1/04 102/301
5,056,595 A * 10/1991 Desbrandes ..... E21B 49/10 166/100
5,224,556 A 7/1993 Wilson et al.
5,228,518 A 7/1993 Wilson et al.
5,369,579 A * 11/1994 Anderson ..... E21B 23/065 175/4.54
5,429,192 A 7/1995 Huber et al.
5,777,257 A * 7/1998 Kenny ..... E21B 29/02 102/307
5,992,523 A 11/1999 Burleson et al.
6,009,947 A * 1/2000 Wilson ..... E21B 43/11 166/100
6,012,525 A 1/2000 Burleson et al.
6,651,747 B2 * 11/2003 Chen ..... E21B 23/01 166/212
6,755,249 B2 * 6/2004 Robison ..... E21B 43/103 166/262
7,422,069 B2 9/2008 Richard et al.
8,127,832 B1 * 3/2012 Bond ..... E21B 43/25 166/63
9,217,305 B2 * 12/2015 Coles ..... E21B 47/09
2004/0104029 A1 * 6/2004 Martin ..... E21B 43/117 166/298
2008/0066912 A1 * 3/2008 Freyer ..... E21B 43/11 166/297
2009/0223659 A1 9/2009 Hill et al.
2013/0081803 A1 4/2013 Tao et al.
2014/0262271 A1 9/2014 Martinez et al.
2015/0176406 A1 * 6/2015 Corre ..... E21B 49/088 166/250.01
2017/0052011 A1 * 2/2017 Parks ..... E21B 43/1185
2017/0328134 A1 * 11/2017 Sampson ..... F42D 1/043
2021/0277724 A1 * 9/2021 Harrigan ..... E21B 43/1185

* cited by examiner

SYSTEM AND METHOD FOR CENTRALIZING A TOOL IN A WELLBORE

BACKGROUND

Downhole tools are conveyed into wellbores to perform various tasks. In some instances, gravity may cause the downhole tool to become decentralized in deviated and/or horizontal wells. Portions of certain downhole tools, such as perforating guns, may be less effective in a decentralized position. For example, perforating charges of perforating guns lose energy and penetrate less effectively when the perforating charges are further from a surface of a tubular in the wellbore, which occurs in some directions when perforating guns are not centralized. However, including a system that centralizes a downhole tool may increase the diameter of the downhole tool, thereby restricting access of the downhole tool in certain sections of the wellbore may include a reduced diameter. Increasing the diameter of a downhole tool may cause the downhole tool to be unable to access and/or pass the sections of the wellbore that have a reduced diameter.

BRIEF DESCRIPTION OF THE DRAWINGS

Embodiments of the system and method for centralizing a tool in a wellbore are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure provides systems and methods for centralizing a downhole tool in a wellbore.

Figure 1:
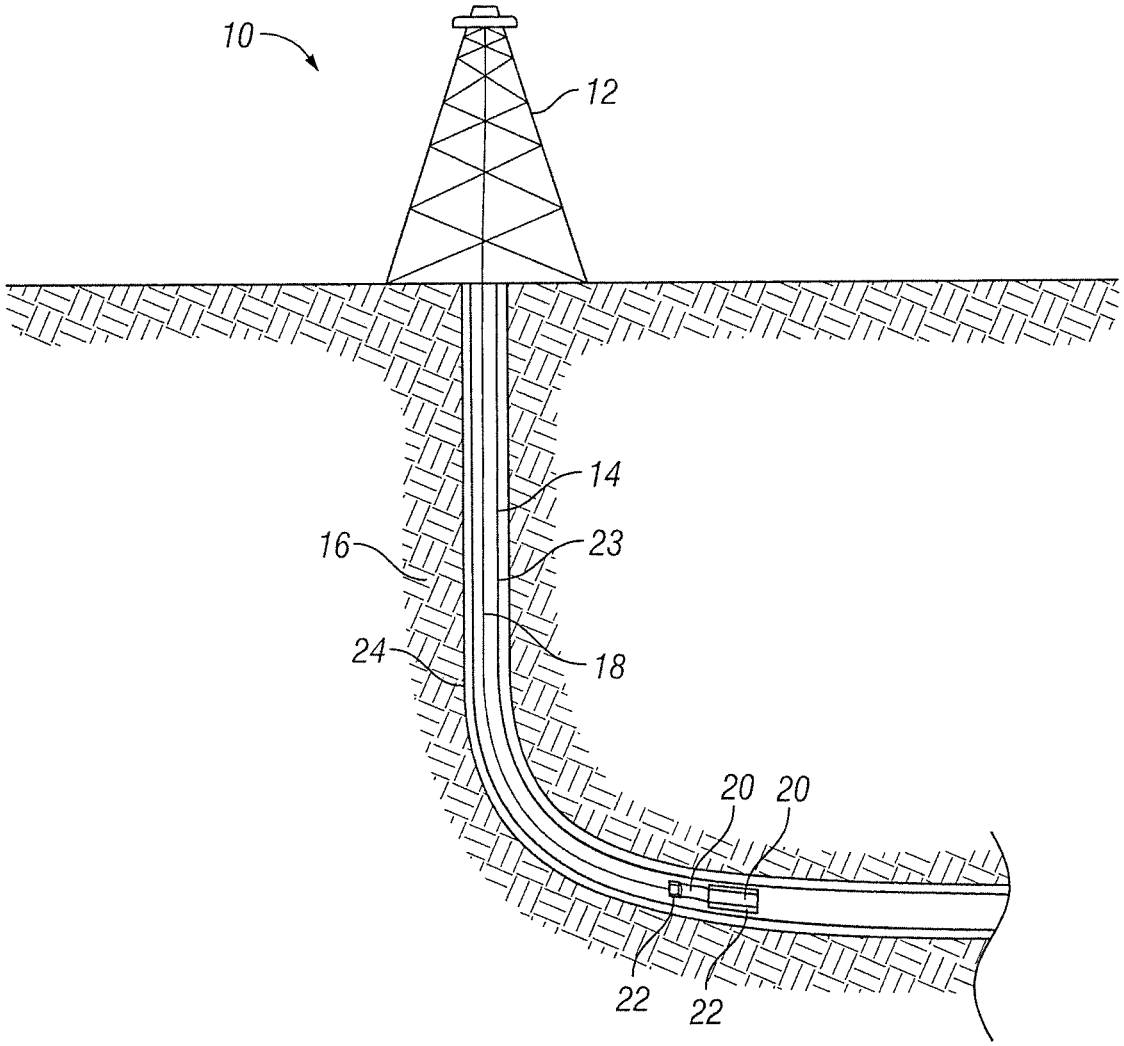
FIG. 1 illustrates a wellbore system that includes downhole tools positioned within a wellbore that extends into a formation, according to one or more embodiments.

FIG. 1 illustrates a wellbore system 10 that includes a rig 12 that is positioned over a wellbore 14 that extends into a formation 16. The wellbore 14 is an opening in the formation 16 and may include a tubular such as a casing or a lining or the wellbore 14 may be an open hole. The wellbore 14 is used to extract fluids or store fluids, such as hydrocarbons or water. Further, while the wellbore 14 is shown as extending vertically and horizontally into the formation 16, the wellbore 14, or portions of the wellbore 14, may extend at any angle between vertical and horizontal. In some embodiments, the wellbore 14 may extend only vertically into the formation 16.

The rig 12 is utilized to aid in operations that include the use of the wellbore 14. For example, the rig 12 includes a drilling rig, a completion rig, a workover rig, or a servicing rig. The rig 12 supports the wireline 18, which conveys one or more downhole tools 20 into the wellbore 14. The position of the downhole tools 20 in the wellbore 14 may be monitored, such as by sensors positioned on the downhole tools 20 or by measuring a length of wireline 18 conveyed into the wellbore 14. In one or more embodiments, the rig 12 supports a slickline unit, a tubular string, a hoisting apparatus, a servicing vehicle, or a coiled tubing unit. Further, the wellbore system 10 may be positioned at an offshore location. For example, the rig 12 may be supported by piers extending into the seabed or by a floating structure.

The wireline 18 supports one or multiple downhole tools 20. One or more of the downhole tools 20 includes a centralizing system 22 that centralizes one or more downhole tools 20 within the wellbore 14 or within a tubular 23 within the wellbore, e.g., a casing or liner. For example, the centralizing system 22 may be included on a portion of one of the downhole tools 20, the centralizing system 22 may surround one of the downhole tools 20, or the centralizing system 22 may be positioned proximate to one of the downhole tools 20. As described in detail below, the centralizing system 22 includes an extendable member 52 that engages a tubular wall or a casing wall 24 to bias the associated downhole tool 20 into a centralized position within the tubular or wellbore. Further, in one example, the downhole tools 20 include perforating tools, which each include one or more explosive charges to perforate the tubular wall 23. Perforation of the tubular 23 enables extraction of fluids from the formation 16.

Further, the centralizing system 22 includes an extendable member that extends into engagement with the tubular 23 to centralize the downhole tool 20. As discussed in greater detail below, the extendable member may include any structure that extends in response to an increase in pressure. For example, the extendable member may be inflatable or a solid member that is pushed outwardly. For example, the extendable member may be positioned within the downhole tool 20 and extend from the downhole tool 20. The extendable member may extend over the downhole tool 20 to surround at least a portion of the downhole tool 20 and inflate into engagement with the tubular 23 to centralize the downhole tool 20. Further, the extendable member may be an arm that rotates about a pivot into engagement with the tubular 23 to centralize the downhole tool 20.

In addition, the extendable member may be actuated by a power charge. For example, a power charge may ignite, releasing gas and thereby increasing pressure. This gas and increase in pressure can be used to directly inflate the extendable member and/or the gas and increase in pressure can be used to operate a mechanism that extends the extendable member, as described in further detail below. The gas produced by the power charge may be contained in a chamber that is pressure isolated from the rest of the downhole tool such that other components of the downhole tool are not exposed to the increase in pressure. Further, the power charge may be a part of a ballistic sequence that includes perforating charges. For example, a detonator may initiate a ballistic sequence that initiates the power charge and perforating charges.

Figure 2A:
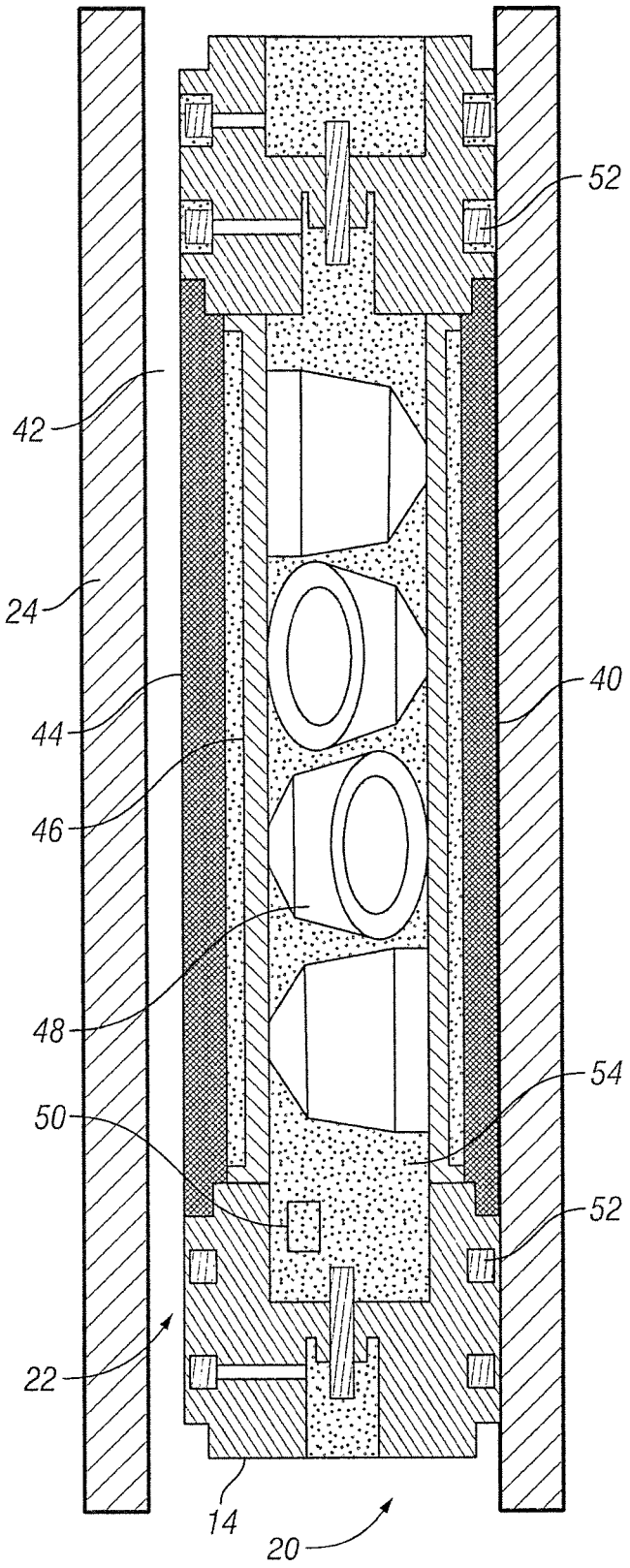
FIG. 2A illustrates a downhole tool that includes a centralizing system in a retracted position, according to one or more embodiments.

FIG. 2A illustrates the downhole tool 20 with the centralizing system 22 in a retracted position and located within a casing 23 with the casing wall 24. As the downhole tool 20 travels through the wellbore 14, the downhole tool 20 may become positioned closer to one portion of the casing wall 24 than another portion of the casing wall 24, which may be considered a decentralized position. For example, the downhole tool 20 is illustrated in contact with an interior diameter 40 of the casing wall 24, thereby leaving an uneven gap 42 on one side of the downhole tool 20. The downhole tool 20 may become decentralized by gravity when in an angled or horizontal portion of the wellbore 14 or there may be obstructions (e.g., uneven distribution of fluids) that bias the downhole tool 20 toward the casing wall 24.

The efficiency of certain downhole tools 20 may be enhanced by centralizing the downhole tool 20. For example, as illustrated in FIG. 2A, the downhole tool 20 may be a perforating gun that includes a tool housing 44, a charge loading tube 46, and explosive charges 48. Further, an interior 54 of the downhole tool 20 is enclosed by the tool housing 44. The tool housing 44 has an outer diameter that determines the minimum diameter casing through which the downhole tool 20 may pass. As illustrated, the extendable member 52 comprises an inflatable member that, when in the retracted position, does not extend further than the outer diameter of the tool housing 44, which, in turn, does not affect the minimum diameter through which the downhole tool 20 may pass.

As the downhole tool 20 reaches a desired location, the explosive charges 48 may be detonated to perforate the casing wall 24 to enable and/or enhance the extraction of fluids from the formation 16. A power charge 50 is included to initiate the detonation of the explosive charge 48. The power charge 50 may be actuated hydraulically, pneumatically, or electrically. Further, the power charge 50 produces a fluid upon actuation via either ignition or a chemical reaction. The power charge 50 may be initiated separately from a charge that detonates the explosive charge 48. For example, the power charge 50 may be attached to a separate igniter, which may be controlled by a separate switch (e.g., hydraulic, pneumatic, or electric). In this configuration, the initiation of the power charge 50 is not linked to the initiation of the explosive charge 48, enabling the power charge 50 to be further isolated from the explosive charge 48.

In one or more embodiments, initiation of the power charge 50 is linked to the initiation of the explosive charge 48. For example, the power charge 50 and the explosive charge 48 may be linked on a timed chain and/or ignition circuit such that the power charge 50 is initiated before the explosive charge 48 is initiated. In this configuration, the initiation of the power charge 50 and the explosive charge 48 are linked which may improve reliability of the timing of the initiation.

Figure 2B:
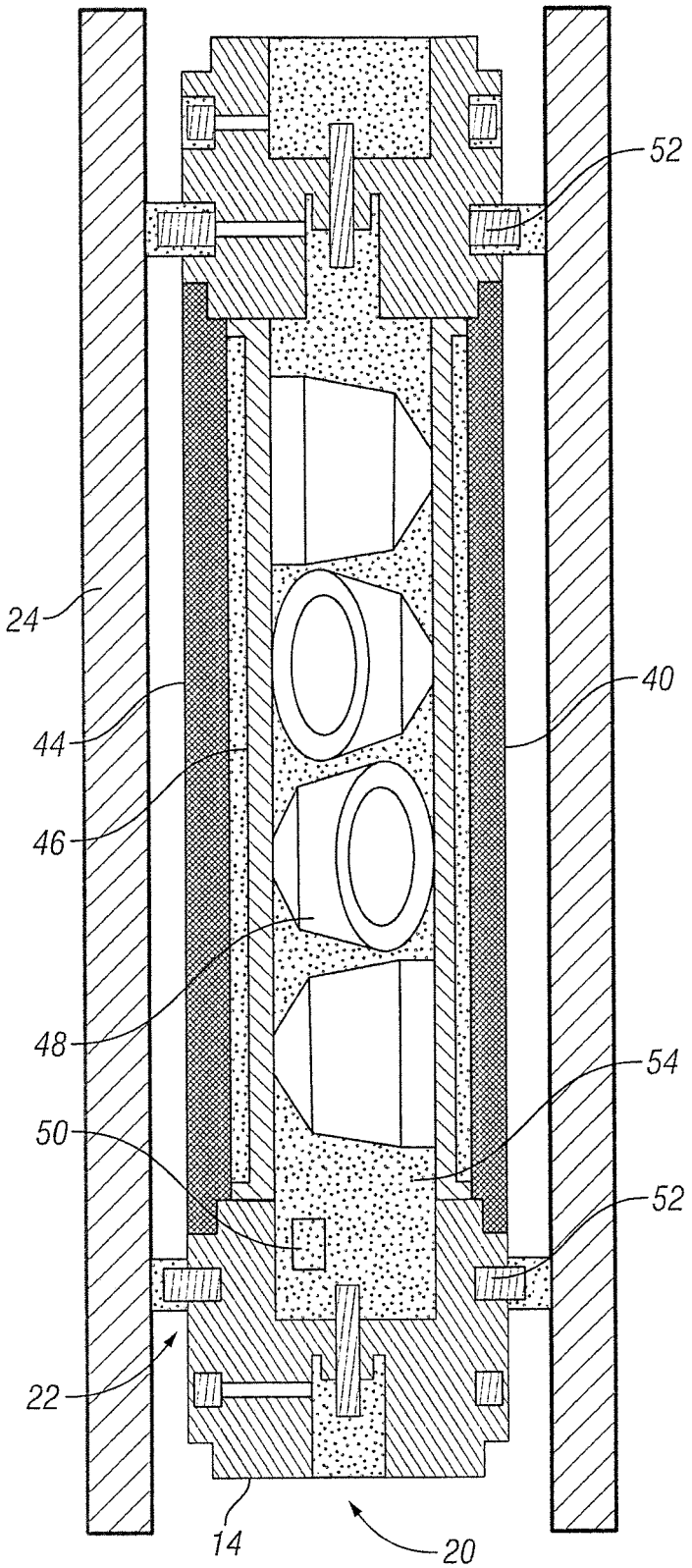
FIG. 2B illustrates the downhole tool that includes the centralizing system of FIG. 2A with an ignited power charge, according to one or more embodiments.

Further, the power charge 50 may be utilized to activate the centralizing system 22 to extend an extendable member 52 from the retracted position to an extended position show in FIG. 2B. For example, actuation of the power charge 50 actuates the extendable member 52 prior to detonating the explosive charges 48 to centralize the downhole tool 20 prior to initiation of the explosive charges 48. Centralization of the downhole tool 20 prior to initiation of the explosive charges 48 provides a more uniform perforation of the casing wall 24.

Turning to FIG. 2B, the power charge 50 has ignited, thereby generating a fluid that increases the pressure within the interior 54 of the downhole tool 20 to extend the extendable member 52 into the extended position. An extendable member 52 is included on both longitudinal sides of the downhole tool 20 to balance the centralization of the downhole tool 20. In some embodiments, more extendable members 52 may be included on one longitudinal side of the downhole tool 20 to accommodate, for example, for uneven weight distribution. Further, extendable members 52 may also only be included on one side of the downhole tool 20 to produce a desired positioning.

After the extendable members 52 are in the extended position, the downhole tool 20 is pushed away from the casing wall 24 and into a centralized position within the casing. Once the downhole tool 20 is in the centralized position, the explosive charges 48 are detonated to perforate the casing wall 24.

Detonation of the explosive charges 48 also introduces holes into the tool housing 44 that equalize the pressure between the interior 54 and the wellbore 14. Equalization of the pressure may cause the extendable member 52 to retract from the extended position of FIG. 2B to the retracted position of FIG. 2A, thereby releasing the downhole tool 20 from the casing wall 24 and allowing the downhole tool 20 to be moved within or removed from the wellbore 14.

Figure 3:
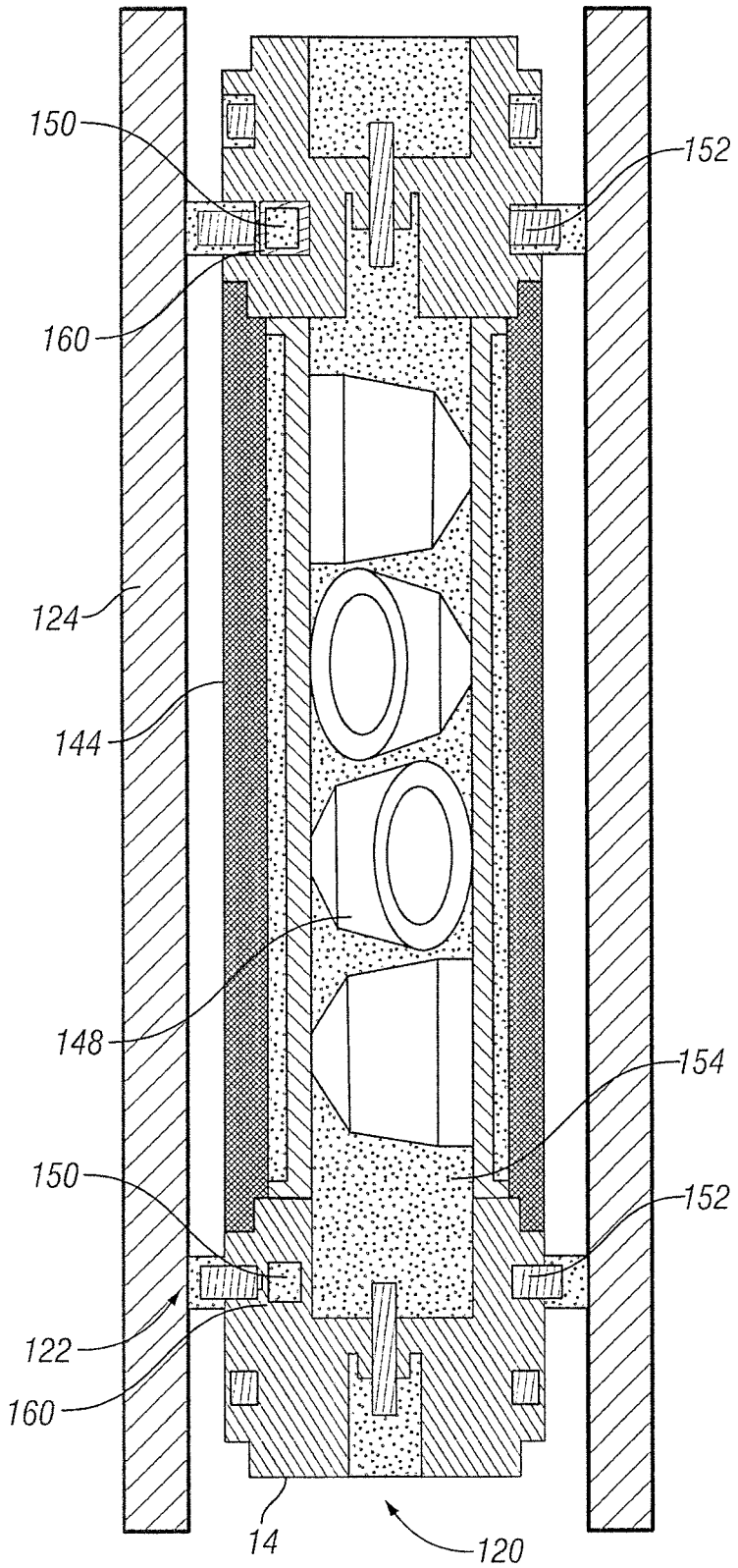
FIG. 3 illustrates a downhole tool that includes a centralizing system in an extended position, according to one or more embodiments.

FIG. 3 illustrates the downhole tool 120 that includes the centralizing system 122 in the extended position. The power charge 150 is included in a chamber 160 that is fluidly separate from the interior 154. For example, the fluid produced by the power charge 150 will not enter the interior 154 to increase the pressure within the interior 154. By not increasing the pressure within the interior 154, the explosive charges 148 are not introduced to an elevated pressure prior to their detonation which prevents movement of the explosive charges 148 prior to detonation of the explosive charges 148.

Further, a power charge 150 is included for each of the extendable members 152 because one power charge 150 is not fluidly coupled to multiple extendable members 152 via the interior 154. Passageways may alternatively be included to fluidly couple multiple extendable members 152 to one power charge 150. The downhole tool 120 may also include additional structure to reduce the pressure that extends the extendable members 152 to enable the extendable members 152 to retract after the explosive charges 148 are initiated, thereby enabling the downhole tool 120 to be moved within or removed from the wellbore 14. For example, a rupture disk may be included that, when ruptured, enables fluid to escape from the chamber 160, thereby lowering the pressure acting on the extendable member 152. The rupture disk may be included in proximity to a detonating cord or a booster (e.g., an explosive capsule) that ruptures the rupture disk in response to the explosive charges 148 detonating. Further, a valve may be included that releases fluid from the chamber 160 in response to a threshold pressure. For example, the threshold pressure, measured as a differential with respect to pressure within the wellbore 14, may be 250 pounds per square inch (psi), 500 psi, 750 psi, 1000 psi, 2500 psi, 5000 psi, or more. Further, the downhole tool 120 may include a valve to release fluids when the pressure within the chamber 160 is higher than the pressure in the wellbore 14 or the interior 154. Release of fluid from the chamber 160 causes the pressure between the chamber 160 and the interior 154 or wellbore 14 to equalize, which, in turn, causes the extendable members 152 to retract and disengage from the casing wall 24.

Further, the extendable members 152 may retract in response to certain directional forces. For example, if the downhole tool 120 is pulled in a longitudinal direction, a shear force may be introduced on the extendable member 152 that causes the extendable member 152 to either become unsealed or tear open, thereby equalizing pressure between the chamber 160 and the wellbore 14. Further, the amount of pressure created by the power charge 150 may cause the extendable member 152 to continue extending past the extended position until the extendable member 152 fails, thereby equalizing the pressure between the chamber 160 and the wellbore 14. Reduction of the pressure within the chamber 160 enables the extendable member 152 to retract and disengage from the casing wall 24, which, in turn, enable the downhole tool 120 to be moved within or removed from the wellbore 14.

Figure 4:
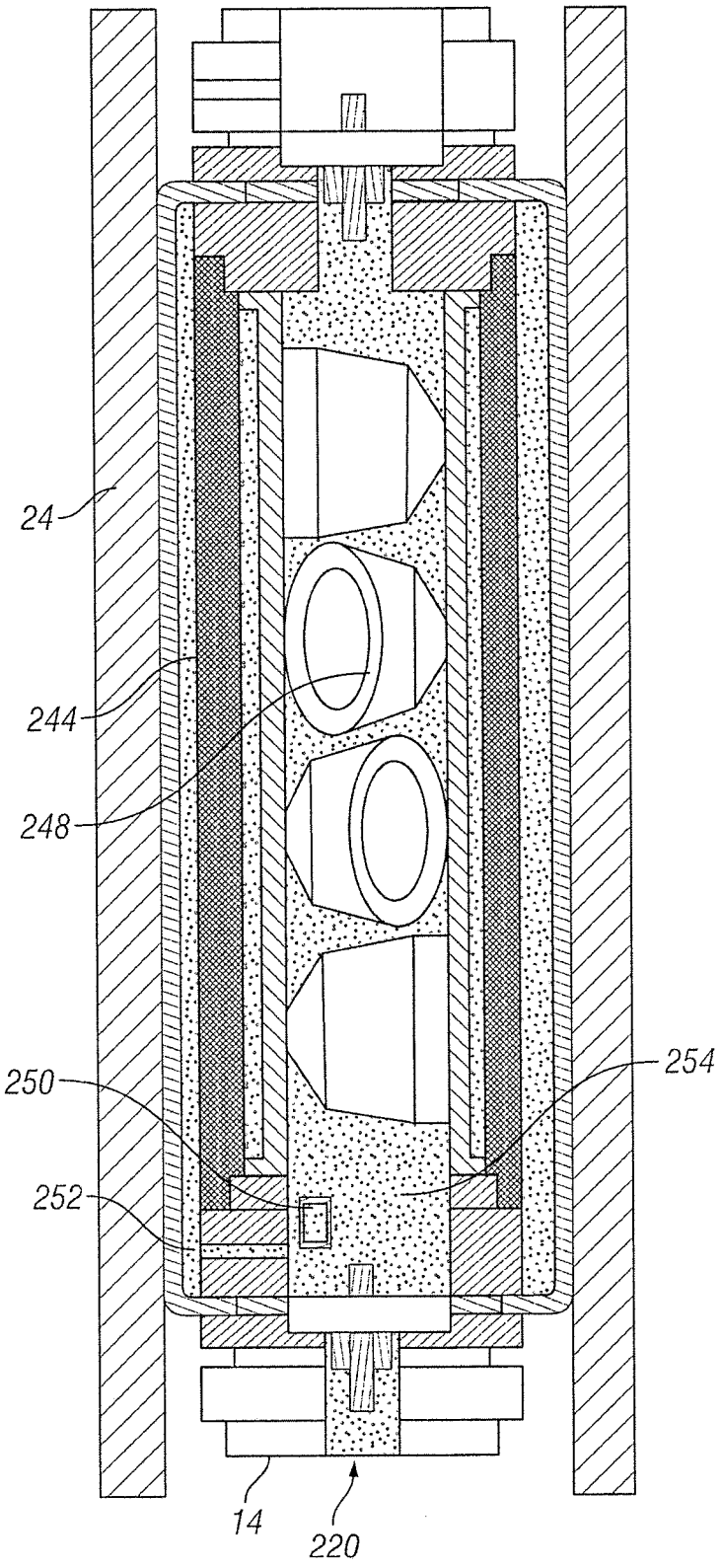
FIG. 4 illustrates a downhole tool that includes a centralizing system as a bladder extending over a portion of the downhole tool, according to one or more embodiments.

FIG. 4 illustrates the extendable member 252 as a bladder that extends over a portion of the downhole tool 220. The extendable member 252 is fluidly coupled to the interior 254 such that when the power charge 250 releases a fluid, the fluid fills both the interior 254 and the extendable member 252, thereby extending the extendable member 252 into the illustrated extended position. Thus, when the extendable member 252 is in the extended position, the explosive charges 48 do not penetrate fluids contained within the wellbore 14. Rather, the explosive charges penetrate the tool housing 244, the fluid within the tool housing 244, the extendable member 252, and the casing wall 24. Avoiding penetration of fluids within the wellbore 14 may increase the depth and diameter of the perforations in the formation. Further, after the explosive charges 248 penetrate the extendable member 252, the pressure within the extendable member 252 equalizes with the pressure within the wellbore 14, thereby causing the extendable member 252 to retract and enable the downhole tool 220 to be moved within or removed from the wellbore 14.

Figure 5:
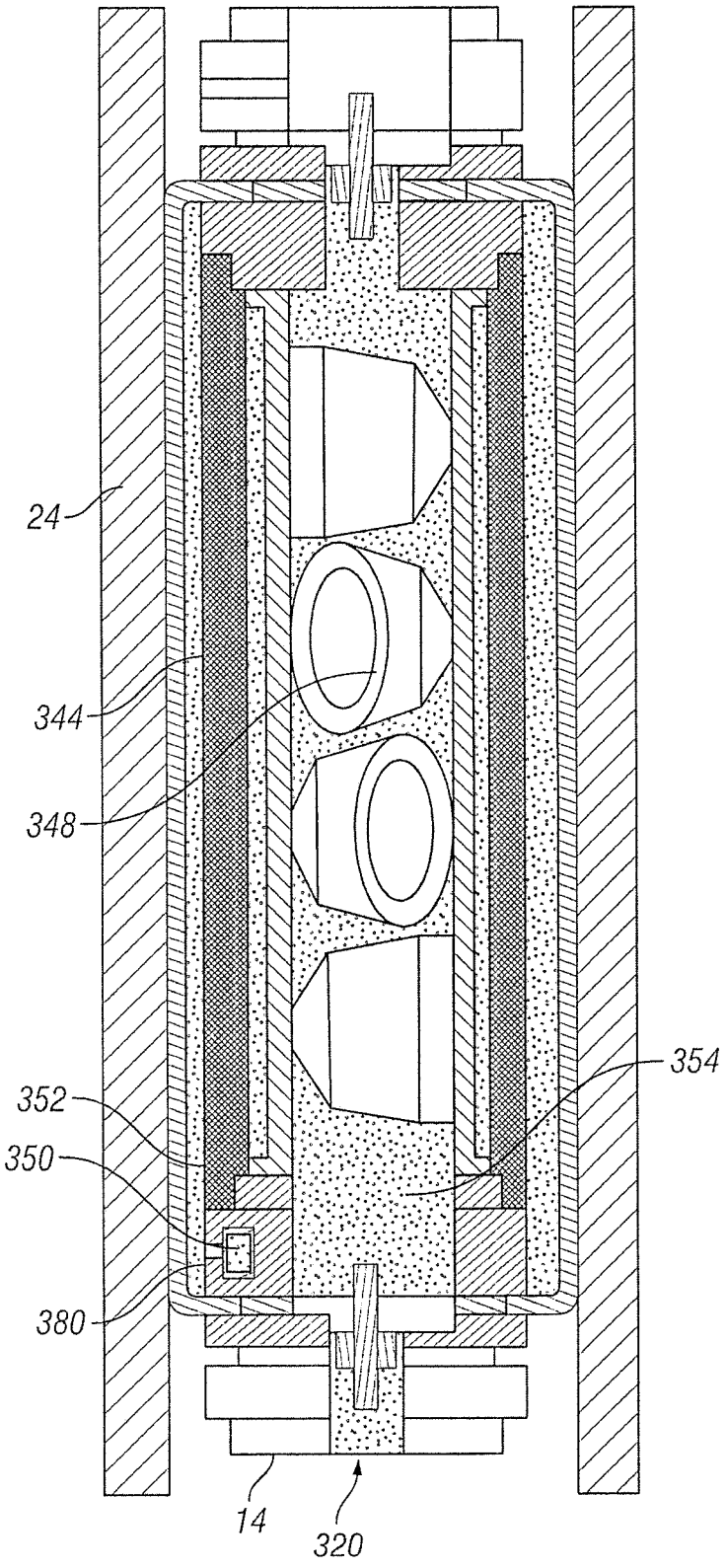
FIG. 5 illustrates a downhole tool that includes a centralizing system as a bladder extending over a portion of the downhole tool, according to one or more embodiments.

FIG. 5 illustrates the extendable member 352 as a bladder that extends over a portion of the downhole tool 320 and is fluidly separate from the interior 354. The power charge 350 is included in a chamber 380 that is fluidly separate from the interior 354. For example, the fluid produced by the power charge 350 will not enter the interior 354 to increase the pressure within the interior 354. By not increasing the pressure within the interior 354, the explosive charges 348 are not introduced to an elevated pressure prior to their detonation which may prevent movement or a change in orientation of the explosive charges 348 prior to initiation of the explosive charges 348. When the extendable member 352 is in the extended position, the explosive charges 348 do not penetrate fluids contained within the wellbore 14. Rather, the explosive charges penetrate the tool housing 344, the fluid within the extendable member 352, the extendable member 352, and the casing wall 24. Avoiding penetration of fluids within the wellbore 14 may increase the depth and diameter of the perforations in the formation. Further, after the explosive charges 348 penetrate the extendable member 352, the pressure within the extendable member 352 equalizes with the pressure within the wellbore 14, thereby causing the extendable member 352 to retract, thereby enabling the downhole tool 320 to be moved within or removed from the wellbore 14.

Figure 6A:
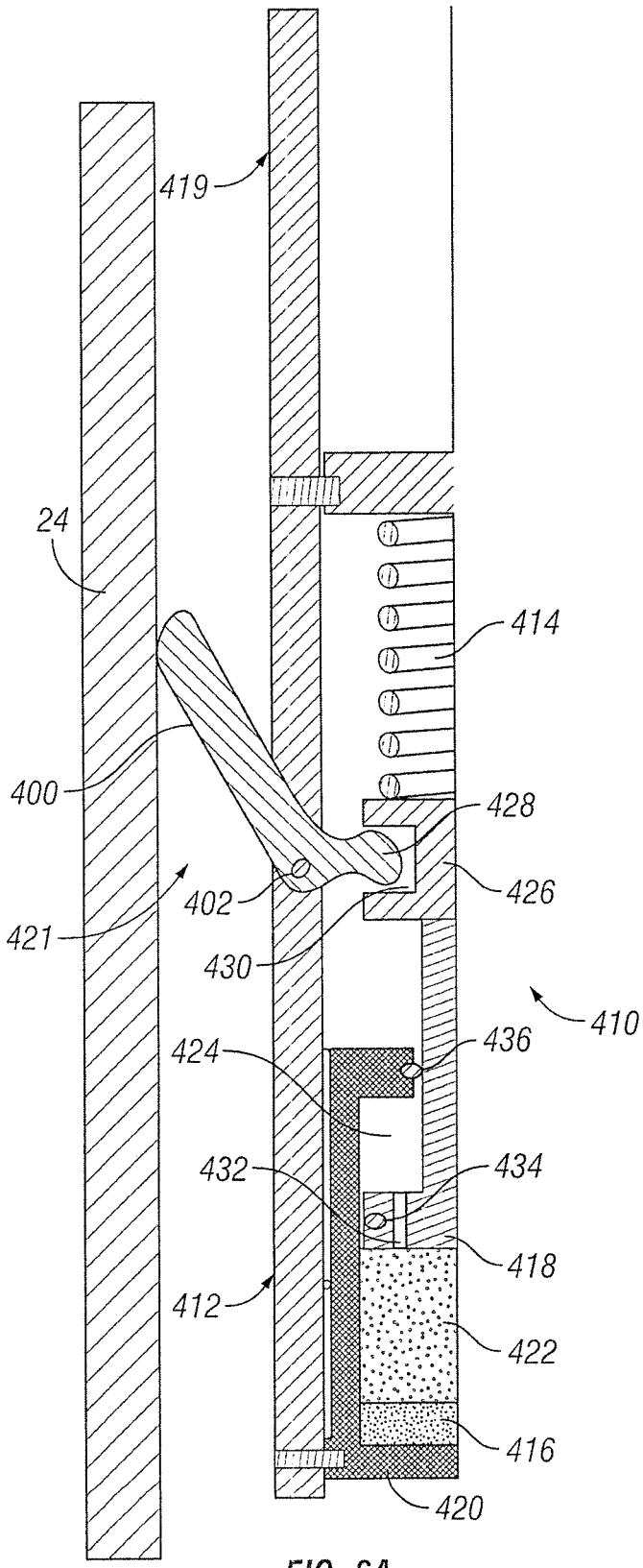
FIG. 6A illustrates a downhole tool that includes a centralizing system as an arm extendable into engagement with a surface of a wellbore, according to one or more embodiments.

FIG. 6A illustrates the extendable member 421 as an arm 400 that rotates about a pin 402 to extend into contact with the casing wall 24, thereby biasing the downhole tool 419 into a centralized position. The arm 400 is rotated by an axial displacement system 410 that includes a piston system 412 and a bias member 414 (e.g., a spring, a compressible fluid, etc.).

The piston system 412 includes a power charge 416 (e.g., an explosive or combustible member), a piston 418, and a cylinder 420 with a first chamber 422 and a second chamber 424. Further, the piston 418 is coupled to an arm retainer 426 that retains an end 428 of the arm 400 in a slot 430 of the arm retainer 426. When the power charge 416 ignites, the power charge 416 creates an increase in pressure within the first chamber 422, thereby biasing the piston 418 away from the power charge 416. As the piston 418 moves away from the power charge 416, the arm retainer 426 also moves away from the power charge 416. Further, the movement of the arm retainer 426 causes the arm 400 to rotate about the pin 402 and extend into contact with the casing wall 24. As the arm 400 contact the casing wall 24, the arm 400 biases the downhole tool 419 into a centralized position.

The downhole tool 419 also includes structure that enables the arm 400 to automatically retract after extension, thereby enabling the downhole tool 419 to be moved within or removed from the wellbore 14. The piston 418 includes a slot 432 that fluidly couples the first chamber 422 and the second chamber 424 which allows the pressures within the first chamber 422 and the second chamber 424 to equalize over time. As the pressures within the first chamber 422 and the second chamber 424 equalize, the biasing force provided by the bias member 414 overcomes the pressure differential between the first chamber 422 and second chamber 424 to push the arm retainer 426 and the piston 418 back toward the power charge 416, thereby retracting the arm 400.

The piston system 412 may include additional slots to fluidly couple the first chamber 422 and/or the second chamber 424 to areas surrounding the cylinder 420. Further, the piston system 412 includes a first seal 434 that blocks fluid from flowing between an edge of the piston 418 and a wall of the cylinder 420. The piston system 412 also includes a second seal 436 that blocks fluid from flowing between an edge of the piston 418 and out of the cylinder 420. The first seal 434 and the second seal 436 provide a more consistent motion of the piston 418 and increase the control of fluid flowing between different areas.

Figure 6B:
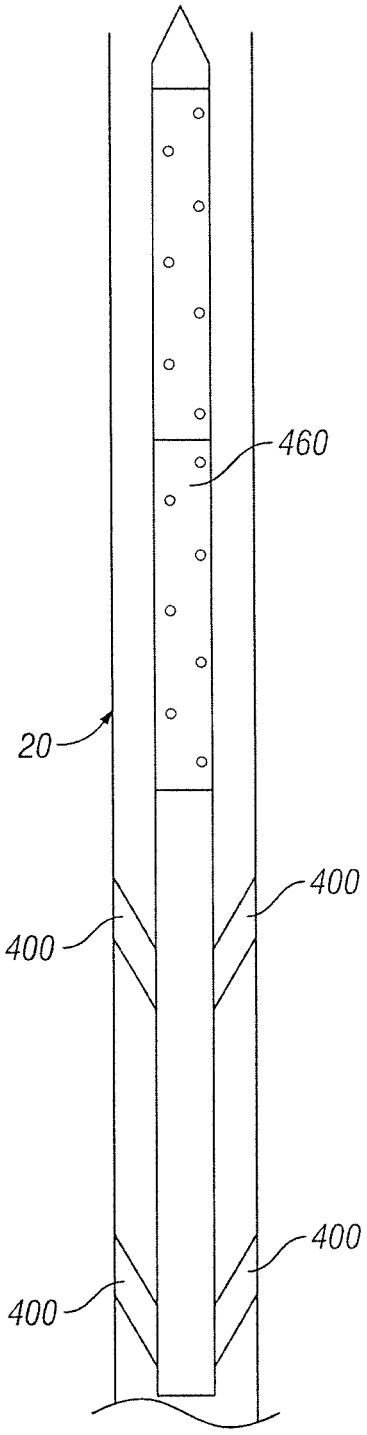
FIG. 6B illustrates a downhole tool that includes multiple centralizing systems illustrated in FIG. 6A, according to one or more embodiments.

The downhole tool 419 may also include multiple arms 400 positioned at different axial and circumferential positions, as illustrated in FIG. 6B. The arms 400 are illustrated as being in two distinct axial positions, each axial position having two arms 400 equally circumferentially distributed. Further, the arms 400 are positioned upstream of a perforating gun 460. In some embodiments, the arms 400 may be positioned in more than two axial positions. Further, each axial position may include more than two arms 400, and the arms 400 may not be equally circumferentially distributed. Having arms 400 in at least two distinct axial positions increases the centralization of the perforating gun 460.

Figure 7:
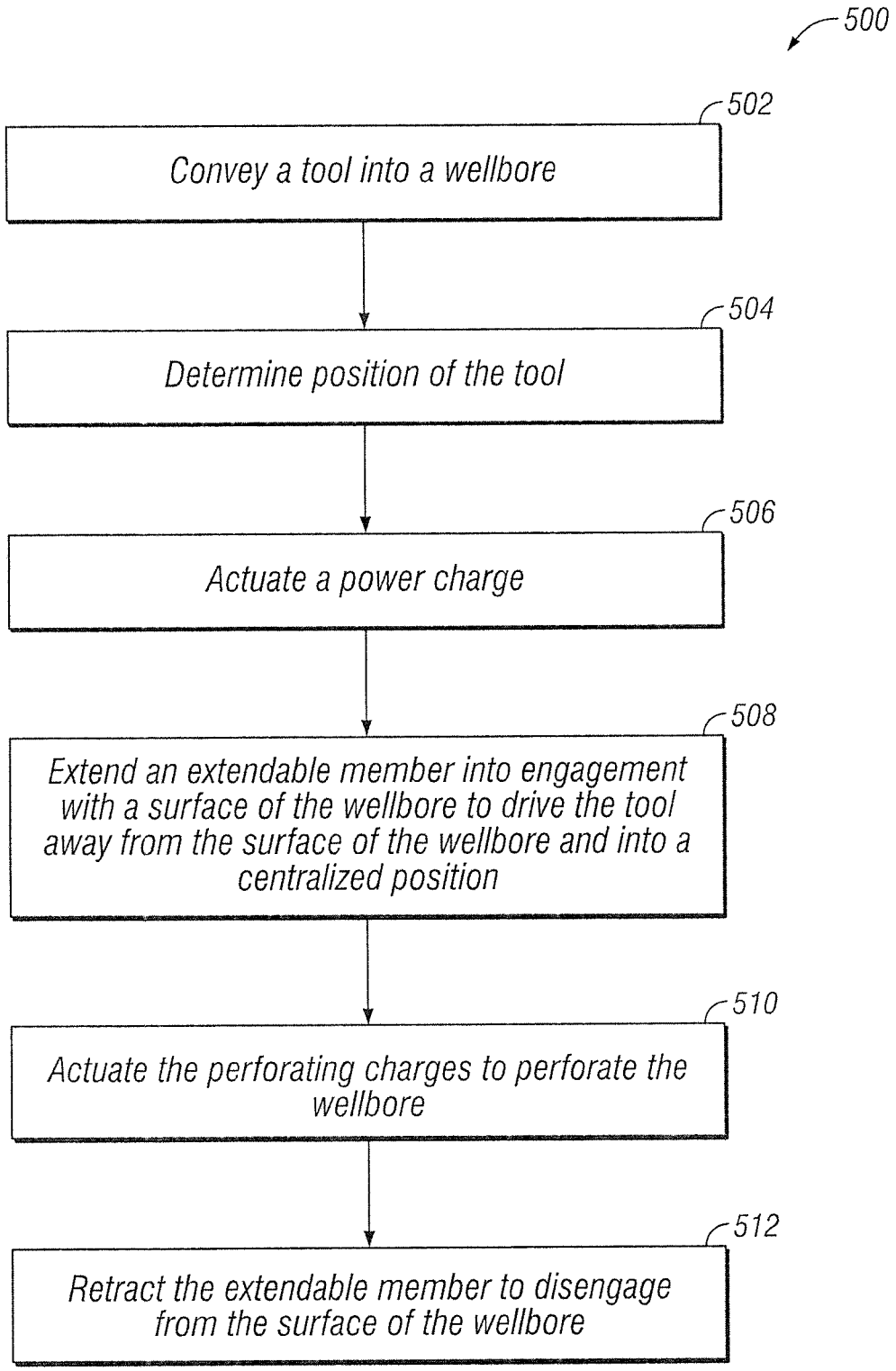
FIG. 7 is a flow chart for centralizing a downhole tool in a wellbore, according to one or more embodiments.

FIG. 7 illustrates a flow chart 500 for centralizing a downhole tool in a wellbore. A downhole tool having an extendable member is conveyed downhole into a wellbore in step 502. The position of the downhole tool is monitored as the downhole tool travels through the wellbore. The functionality of the downhole tool may be desired at a particular position downhole. Thus, the position of the downhole tool is determined in step 504.

Once the downhole tool is in the desired position, centralization of the downhole tool may begin. As described above, the downhole tool may become decentralized as it travels through the wellbore. For deviated and/or horizontal wells, gravity may bias the downhole tool into a decentralized position. In some instances, there may be obstructions that bias the downhole tool into a decentralized position. To begin the centralization of the downhole tool, a power charge is actuated in step 506 to provide the energy to centralize the downhole tool.

The actuation of the power charge in step 506 causes an extendable member to extend in step 508. As the extendable member extends, the extendable member engages a surface of the casing, which biases the downhole tool away from the surface of the casing and into a centralized position.

In embodiments in which the downhole tool is a perforating gun, perforating charges are actuated to perforate the wellbore in step 510 after the downhole tool is in the centralized position. Actuation of the perforating charges when the downhole tool is in the centralized position provides a more even perforation of the wellbore. As described in more detail below, a more even perforation of the wellbore enhances the extraction of formation fluids.

After the extendable member has centralized the downhole tool and/or the perforating charges have been actuated, the extendable members are retracted in step 512 to disengage the extendable member from the surface of the wellbore, thereby enabling the downhole tool to be moved within or removed from the wellbore. As described above, the extendable member may also disengage from the surface of the wellbore via a shear force. For example, the extendable member may not retract, and a shear force may be applied to the extendable member (e.g., via pulling the downhole tool in an uphole direction). In response to the shear force, the extendable member may shear and retract from the surface of the wellbore. After the extendable member retracts, the downhole tool is free to be moved to another position within the wellbore or pulled out of the wellbore. Those skilled in the art will see that the described method and apparatus is not limited to positioning perforating tools but may be used to centralize other downhole equipment. It may also be appreciated by those skilled in the art that adaptations of the methods and apparatus described here may be used to position tools in a wellbore in a non-centralized location.

Figure 8A:
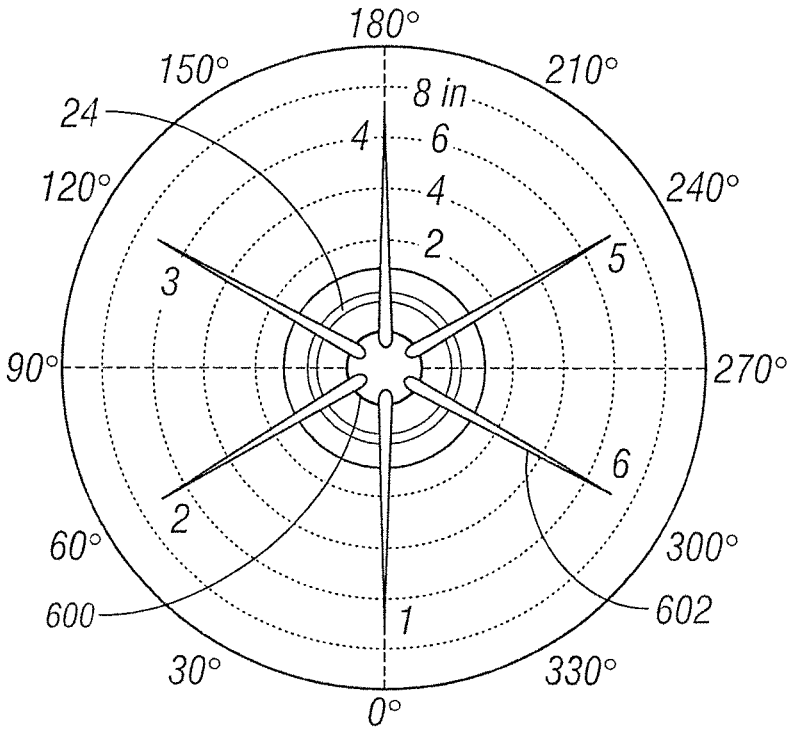
FIGS. 8A and 8B illustrate results of a perforating gun in a centralized position versus a decentralized position.
Figure 8B:
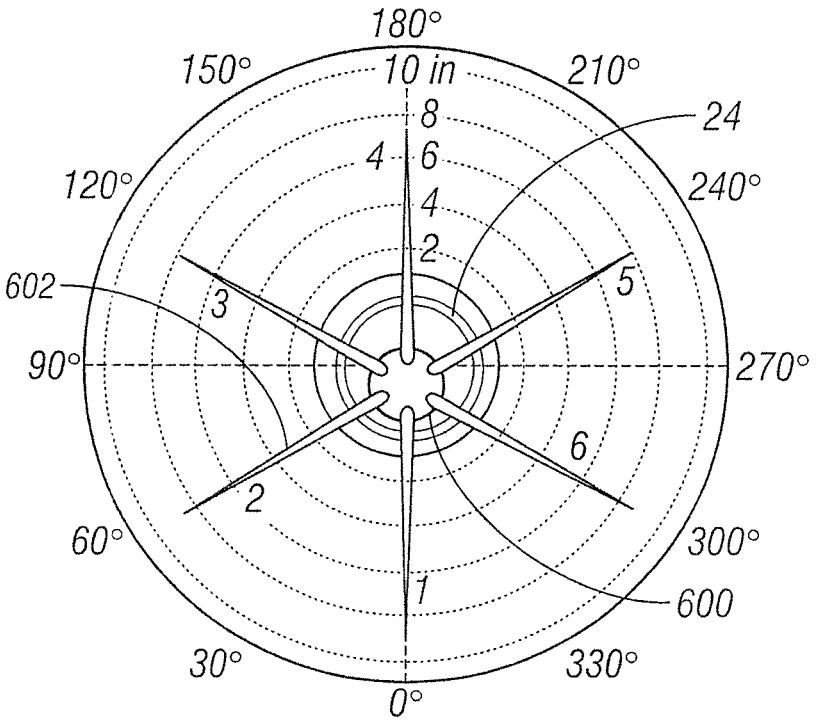

FIG. 8A illustrates a sample result of a perforating gun 600 operating from a centralized position, and FIG. 8B illustrates a sample result of the perforating gun 600 operating from a decentralized position. In the illustrated results, the perforating gun 600 includes six perforating charges equally circumferentially positioned, and each producing a penetration visualization 602. The perforating gun 600 operating from the centralized position in FIG. 8A increases the total penetration as well as the flow area of the hole produced by each of the perforation charges, thereby increasing the production of formation fluid.

Further examples may include:

Example 1 is a centralizing perforating gun for perforating a tubular in a wellbore comprising a gun housing, perforating charges positioned within the gun housing and detonatable to perforate the tubular, and a centralizing system. The centralizing system includes an extendable member configured to move between a retracted position and an extended position. The extendable member is configured to engage a surface of the tubular in the extended position, thereby biasing the centralizing perforating gun away from the surface of the tubular.

In Example 2, the subject matter of Example 1 can further include a power charge ignitable to extend the extendable member from the retracted position to the extended position.

In Example 3, the subject matter of Examples 1-2 can further include wherein the power charge is configured to extend the extendable member prior to detonation of the perforating charges.

In Example 4, the subject matter of Examples 1-3 can further include a detonator detonatable separately from the power charge to initiate a ballistic sequence that detonates the perforating charges.

In Example 5, the subject matter of Examples 1-4 can further include wherein the extendable member is positioned in an isolated chamber that is pressure isolated from the perforating charges.

In Example 6, the subject matter of Examples 1-5 can further include a second extendable member configured to move between the retracted position and the extended position, wherein the second extendable member is configured to engage the surface of the tubular in the second extended position, thereby biasing the centralizing perforating gun away from the surface of and centralized within the tubular, and wherein the extendable member and second extendable member are positioned on opposite longitudinal sides of the perforating charges.

In Example 7, the subject matter of Examples 1-6 can further include a first power charge ignitable to extend the extendable member from the retracted position to the extended position. In addition, the subject matter of Examples 1-6 can further include a second power charge ignitable to extend the second extendable member from the second retracted position to the second extended position.

In Example 8, the subject matter of Examples 1-7 can further include wherein the extendable member is positioned within the gun housing.

In Example 9, the subject matter of Examples 1-8 can further include wherein the extendable member is a bladder positioned around at least a portion of the gun housing.

In Example 10, the subject matter of Examples 1-9 can further include wherein detonation of the perforating charges is configured to puncture the bladder.

In Example 11, the subject matter of Examples 1-10 can further include wherein the bladder is pressure isolated from the perforating charges.

In Example 12, the subject matter of Examples 1-8 can further include wherein the extendable member includes an arm rotatable about a pin to move the arm between the retracted position and the extended position.

In Example 13, the subject matter of Examples 1-8 and Example 12 can further include a piston coupled to a portion of the arm such that axial motion of the piston causes rotation of the arm.

Example 14 is a method for centralizing a perforating gun comprising conveying the perforating gun that includes a gun housing downhole into a wellbore. The method further includes igniting a power charge to extend an extendable member from a retracted position to engage a surface of a tubular within a wellbore in an extended position, thereby biasing the perforating gun away from the surface of the tubular. Moreover, the method includes detonating a perforating charge positioned within the gun housing to perforate a wellbore.

In Example 15, the subject matter of Example 14 can further include extending the extendable member before detonating the perforating charges.

In Example 16, the subject matter of Examples 14-15 can further include retracting the extendable member after detonating the perforating charges.

In Example 17, the subject matter of Examples 14-16 can further include retracting the extendable member in response to rupturing a rupture disc.

In Example 18, the subject matter of Examples 14-17 can further include wherein the extendable member is positioned in a chamber that is pressure isolated from the perforating charges.

In Example 19, the subject matter of Examples 14-18 can further include wherein the extendable member is a bladder positioned around at least a portion of the gun housing, and detonating the perforating charges punctures the bladder.

Example 20 is a system for perforating a wellbore, the system comprising a wireline and perforating guns positioned along the wireline. Each of the perforating guns includes a gun housing, perforating charges positioned within the gun housing and detonatable to perforate the tubular, and a centralizing system. The centralizing system includes an extendable member configured to move between a retracted position and an extended position. The extendable member is configured to engage a surface of the tubular in the extended position, thereby biasing the centralizing perforating gun away from the surface of the tubular.

One or more specific embodiments of the system and method for centralizing a tool in a wellbore have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A centralizing perforating gun for perforating a tubular in a wellbore, the gun comprising:

a gun housing;

perforating charges within the gun housing and detonatable to perforate the tubular; and a centralizing system comprising an extendable member within the gun housing and extendable between a retracted position and an extended position, wherein the extendable member is configured to engage a surface of the tubular when extended, thereby biasing the centralizing perforating gun away from the surface of and centralized within the tubular.

2. The system of claim 1, further comprising a power charge ignitable to extend the extendable member from the retracted position to the extended position.

3. The system of claim 2, wherein the power charge is ignitable to extend the extendable member prior to detonation of the perforating charges.

4. The system of claim 2, comprising a detonator detonatable separately from the power charge to initiate a ballistic sequence that detonates the perforating charges.

5. The system of claim 2, wherein the extendable member is positioned in a chamber that is pressure isolated from the perforating charges.

6. The system of claim 1, comprising a second extendable member extendable between a second retracted position and a second extended position, wherein the second extendable member is configured to engage the surface of the tubular when extended, thereby biasing the centralizing perforating gun away from the surface of and centralized within the tubular, and wherein the extendable member and second extendable member are positioned on opposite longitudinal sides of the perforating charges.

7. The system of claim 6, further comprising:

a first power charge ignitable to extend the extendable member from the retracted position to the extended position; and a second power charge ignitable to extend the second extendable member from the second retracted position to the second extended position.

8. The system of claim 1, wherein the extendable member comprises a bladder positioned around at least a portion of the gun housing.

9. The system of claim 8, wherein detonation of the perforating charges is configured to puncture the bladder.

10. The system of claim 8, wherein the bladder is pressure isolated from the perforating charges.

11. A method for centralizing a perforating gun comprising:

conveying the perforating gun comprising a gun housing downhole into a wellbore;

igniting a power charge to extend an extendable member within the gun housing from a retracted position to engage a surface of a tubular within a wellbore in an extended position, thereby biasing the perforating gun away from the surface of the tubular; and detonating perforating charges positioned within the gun housing to perforate the tubular.

12. The method of claim 11, further comprising extending the extendable member before detonating the perforating charges.

13. The method of claim 11, further comprising retracting the extendable member after detonating the perforating charges.

14. The method of claim 11, further comprising retracting the extendable member in response to rupturing a rupture disc.

15. The method of claim 11, wherein the extendable member is positioned in a chamber that is pressure isolated from the perforating charges.

16. The method of claim 11, wherein the extendable member is a bladder positioned around at least a portion of the gun housing, and detonating the perforating charges punctures the bladder.

17. A system for perforating a wellbore, the system comprising:

a wireline; and perforating guns positioned along the wireline, each perforating gun comprising:

a gun housing;

perforating charges within the gun housing and detonatable to perforate the tubular; and a centralizing system comprising an extendable member within the gun housing and configured to move between a retracted position and an extended position, wherein the extendable member is configured to engage a surface of the tubular in the extended position, thereby biasing the respective perforating gun away from the surface of and centralized within the tubular.

* * * * *